US010555859B2

(12) United States Patent
Davis et al.

(10) Patent No.: US 10,555,859 B2
(45) Date of Patent: Feb. 11, 2020

(54) HEIGHT ADJUSTMENT DELIVERY TABLE

(71) Applicant: Industrial Woodworking Corporation, Zeeland, MI (US)

(72) Inventors: Bradford L. Davis, Holland, MI (US); Lawrence W. Kelly, Zeeland, MI (US)

(73) Assignee: Industrial Woodworking Corporation, Zeeland, MI (US)

( * ) Notice: Subject to any disclaimer, the term of this patent is extended or adjusted under 35 U.S.C. 154(b) by 437 days.

(21) Appl. No.: 15/464,863

(22) Filed: Mar. 21, 2017

(65) Prior Publication Data

US 2018/0271733 A1 Sep. 27, 2018

(51) Int. Cl.

| | |
|---|---|
| ***A61G 13/06*** | (2006.01) |
| ***A61G 13/00*** | (2006.01) |
| *A47B 9/10* | (2006.01) |

(52) U.S. Cl.

CPC ..... *A61G 13/06* (2013.01); *A61G 13/0009* (2013.01); *A47B 9/10* (2013.01)

(58) Field of Classification Search

CPC .. A47B 9/04; A47B 9/10; A47B 21/02; A47C 3/20; A47C 3/24; A47C 3/30; A47C 3/40; A47C 19/045; A61G 1/013; A61G 7/012; A61G 13/0009; A61G 13/006

See application file for complete search history.

(56) References Cited

U.S. PATENT DOCUMENTS 516,587 A * 3/1894 Campbell ..... A61G 7/012 5/611
885,843 A * 4/1908 Fischer et al. ..... A47C 3/30 60/442
947,380 A * 1/1910 Fischer et al. ..... A47C 3/30 248/404
4,108,416 A * 8/1978 Nagase ..... A47C 3/30 248/566
6,224,155 B1 * 5/2001 DeKraker ..... A47C 3/30 248/161
6,230,343 B1 * 5/2001 Buiskool ..... A61G 7/012 5/610
6,276,010 B1 * 8/2001 Way ..... A61G 1/0565 5/11

(Continued)

FOREIGN PATENT DOCUMENTS

DE 10248308 A1 * 4/2004 ..... A47C 3/30
FR 2800251 A1 * 5/2001 ..... A47C 3/30

*Primary Examiner* — Nicholas F Polito

(74) *Attorney, Agent, or Firm* — Warner Norcross + Judd LLP

(57) ABSTRACT

A height adjustment system for a delivery table or the like having a table top supported upon a height adjustable column with an assist cylinder. The system includes an actuator assembly to operate the assist cylinder from manual actuators, such as paddles, located approximately in four corners of table top. The system may include a pair of paddle assemblies mounted under the table top on opposite sides of said assist cylinder. The paddle assemblies may be coupled to the assist cylinder by a linear linkage that translates pivotal movement of a paddle into linear movement sufficient to actuate the assist cylinder. The linear linkage may include a straight drive rod coupled to one paddle assembly and an offset drive rod coupled to the other paddle assembly. The linear linkage may also include a pivot arm to reverse movement of the offset drive rod.

12 Claims, 8 Drawing Sheets

(56) References Cited

U.S. PATENT DOCUMENTS

| | | | | |
|---|---|---|---|---|
| 2004/0065238 | A1* | 4/2004 | Chen | A47B 9/10 108/147 |
| 2004/0065239 | A1* | 4/2004 | Chen | A47B 9/10 108/147 |
| 2004/0111798 | A1* | 6/2004 | Matunaga | A61G 1/0293 5/86.1 |
| 2007/0083993 | A1* | 4/2007 | Lindner | A47C 19/045 5/611 |
| 2013/0282234 | A1* | 10/2013 | Roberts | A61G 1/0268 701/36 |
| 2018/0213927 | A1* | 8/2018 | Sudoh | A47B 9/10 |

* cited by examiner

HEIGHT ADJUSTMENT DELIVERY TABLE

BACKGROUND OF THE INVENTION

The present invention relates to delivery tables and other work surfaces, and more specifically to height-adjustable delivery tables and work surfaces.

Delivery tables are commonly used in the medical industry to assist in patient care, for example, during delivery of newborn children. It is not uncommon for delivery tables to be height-adjustable so that the table top can be placed at the most convenient height. A typical height-adjustable table includes a height-adjustable column with an assist cylinder. The assist cylinder can be locked to secure the column at a specific height or unlocked to allow a user to manually vary the height of the table—usually by lifting up or pushing down on the table top until it is at the desired position. Conventional height adjustment systems often provide a single handle that is can be manually operated to move the assist cylinder into the unlocked state, thereby allowing adjustment of the table top height. This type of system can be inconvenient in that a user may be required to move about the table to locate and operate the handle.

It would be helpful to provide an improved height adjustment system that provides greater convenience and can be reliably implemented into a wide range of applications with limited cost.

SUMMARY OF THE INVENTION

The present invention provides a height adjustment system for a delivery table or similar work surface having a table top supported upon a height adjustable column with an assist cylinder. In one embodiment, the assist cylinder is disposed within the column and includes an actuator that is accessible through the top of the column. The height adjustment system includes an actuator assembly configured to allow a user to operate the assist cylinder from manual actuators, such as paddles, located approximately in four corners of table top. In one embodiment, the height adjustment system includes a pair of paddle assemblies mounted under the table top with one extending along each side. Each paddle assembly is operatively coupled to the assist cylinder actuator by a linkage so that manual operation of a paddle functions to actuate the assist cylinder to facilitate adjustment of the height of the table top.

In one embodiment, each paddle assembly includes a spanning rod with paddles mounted at or near opposite ends. The spanning rod is rotatably mounted to the undersurface of the table top. The paddles may extend in a direction generally perpendicular to the longitudinal axis of the spanning rod so that up and down pivotal movement of a paddle causes rotation of the spanning rod.

In one embodiment, each spanning rod has a pair of doglegs that help to maintain the longitudinal position of the paddle assembly. For example, the spanning rod may be mounted to the undersurface of the table top by brackets and the brackets may be position just inwardly from the doglegs so that interference between the brackets and the bends in the spanning rods prevents substantial longitudinal movement.

In one embodiment, the spanning rods are operatively coupled to the assist cylinder actuator by a linear linkage. For example, the linear linkage may include a straight drive rod, an offset drive rod and a pivot arm that cooperate to operate the assist cylinder actuator. The pivot arm may pivot about its center and have a first end configured to engage the assist cylinder actuator on one side and the straight drive rod on the other. The second end of the pivot arm is configured to engage the offset drive rod.

In one embodiment, each spanning rod has a central leg that operates the linear linkage when the spanning rod is rotated into the release position. For example, the central leg of one spanning rod may engage the straight drive rod and the central leg of the other spanning rod may engage the offset drive rod. In operation, the pivot arm reverses the linear motion of the offset drive rod so that inward motion of either drive rod results in actuation of the assist cylinder actuator.

In the illustrated embodiment, the actuator of the assist cylinder is resiliently biased in the locked position. In this embodiment, the actuator assembly components are arranged so that movement of the assist cylinder actuator into the locked position urges the various component of the actuator assembly into their respective locked position. As a result, the height of the table top assembly remains locked and the actuator assembly remains in the locked position except when a user is manually operating a paddle.

In one embodiment, the end of each drive rod is fitted with an adjustment screw that can be threaded inwardly or outwardly to affect the overall length of the drive rod.

The present invention provides a simple and effective actuation assembly that allows actuation of a height adjustment system for any of the four corners of a table top. The use of combined paddle assemblies simplifies manufacture and assembly. The pivot arm allows inward motion of either drive rod to cause one-way motion of the actuator from the locked to the unlocked position. Further, the internal bias of the assist cylinder actuator biases the drive rods and paddle assemblies into the locked position without the need for supplemental biasing components, such as springs. The adjustment screws in the drive rods allow fine adjustment of the actuator system.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Overview.

Figure 1:
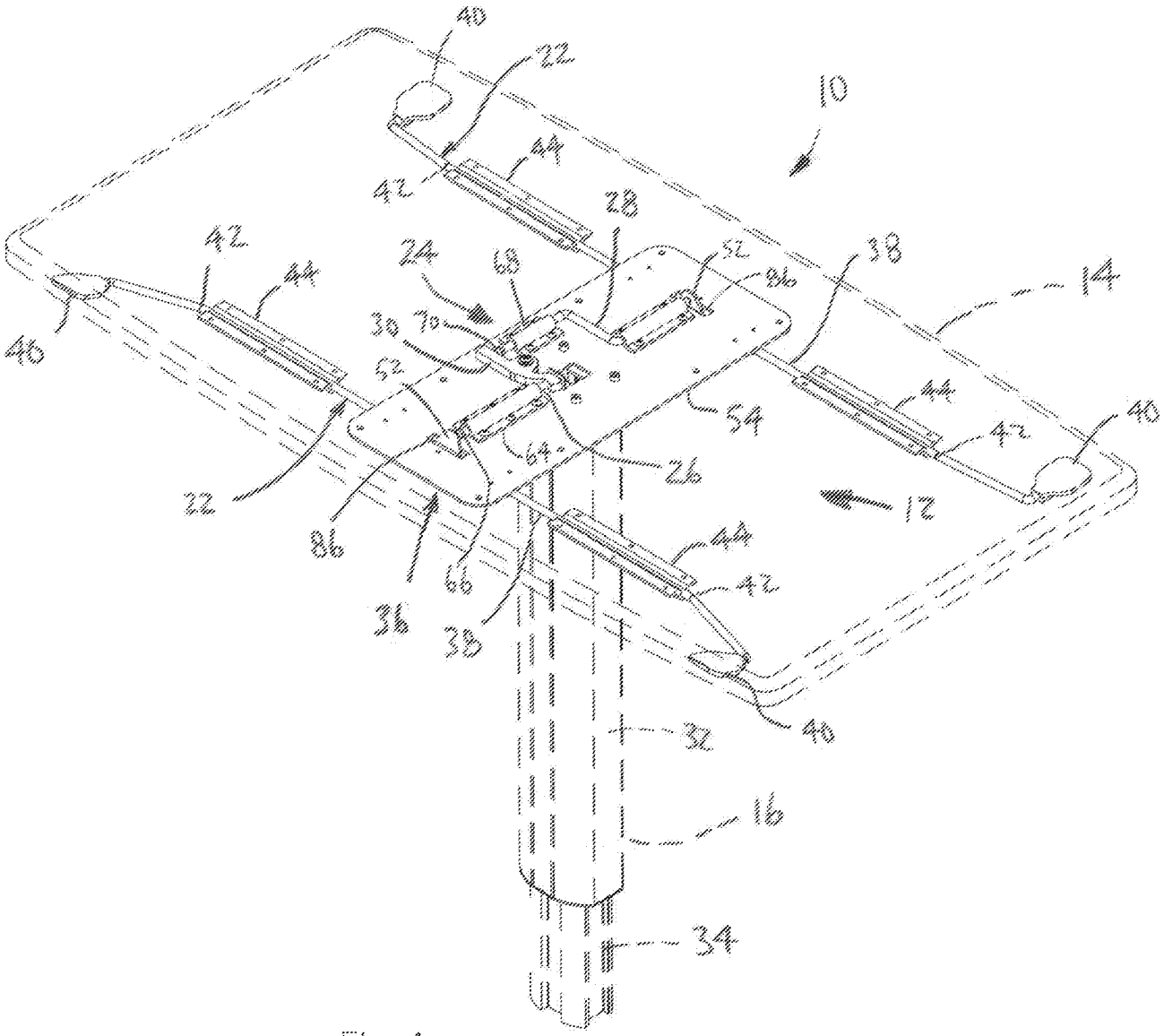
FIG. 1 is a top perspective view of a portion of a delivery table having a height adjustment system in accordance with an embodiment of the present invention.

A portion of a delivery table 10 having a height adjustment system 12 in accordance with an embodiment of the present invention is show in FIG. 1. In this embodiment, the table 10 includes a table top 14 that is mounted upon a height adjustable column 16. An assist cylinder 18 is situated within the column 16. The assist cylinder 18 includes an actuator 20 that is accessible from above the column 16. The height adjustment system 12 includes an actuator assembly 36 having a pair of paddle assemblies 22 that are rotatably mounted to the table top 14. The paddle assemblies 22 are operatively coupled to the actuator 20 by a linkage so that appropriate rotational movement of either paddle assembly 22 moves the actuator 20 to the unlocked position, thereby allowing adjustment to the height of the table top 14. In this embodiment, the paddle assemblies 22 are coupled to the actuator by a linear linkage 24 having a straight drive rod 26, an offset drive rod 28 and a pivot arm 30.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Although described in the context of a delivery table, the height adjustment system of the present invention may be incorporated into other types of tables or work surfaces that are height adjustable.

Height Adjustment System.

As noted above, the present invention is described in the context of a delivery table 10 (See FIGS. 1-8). The delivery table 10 includes a table top 14 that is mounted upon a height adjustable column 16. To facilitate disclosure of the height adjustment system 12, the table top 14 and table column 16 are shown in broken lines. In this embodiment, the column 16 is located at the approximate center of the table top 14, but its position may vary from application to application as desired. To illustrate, the column 16 may be disposed toward one end of the table top 14, for example, in the context of an overbed table. The size, shape and configuration of the table top may vary from application to application. For example, the table tap 14 may alternatively be square, oval, kidney shaped or essentially any other desired shape. Similarly, the size, shape and configuration of the height adjustable column 16 may vary from application to application. In the illustrated embodiment, the column 16 is a telescopic column with an upper section 32 and a lower section 34 that are interfitted to different degrees to vary the height of the column (and consequently the table top 14). An assist cylinder 18 is fitted into the interior of the column 16 between the upper section 32 and the lower section 34. The assist cylinder 18 has locked and unlocked states. In the locked state, the assist cylinder 18 prevents relative motion between the upper section 32 and lower section 34, thereby retaining the table top 14 at the current height. In the unlocked state, the assist cylinder 18 allows relative motion between the upper section 32 and lower section 34. Additionally, the assist cylinder 18 may include internal bias that helps to offset the weight of the table top 14 making it easier for the user to raise and lower the table top 14. The assist cylinder 18 may be one of a variety of conventional assist cylinders available from a variety of well-known suppliers. For example, the assist cylinder 18 may be a Bloc-O-Lift locking gas spring (available from Stabilus GmbH) with a diameter of 28 mm, an extended length of 41 inches and a compressed length of 23 inches. The force of the gas spring amy vary from application to application, for example, depending in part on the weight of the table top. This example assist cylinder 18 and its specifications are merely exemplary. In the illustrated embodiment, the assist cylinder 18 includes an actuator 20 that is mechanically manipulated to move the assist cylinder 18 between the locked and unlocked states. In the illustrated embodiment, the actuator 20 is biased in the locked position and user input is required to move it into the unlocked position. For example, as shown in FIG. 2B, the actuator 20 is a plunger that protrudes from the upper end of the assist cylinder 18. When the plunger is extended, the assist cylinder 18 is in the locked state. When the plunger is sufficiently depressed, the assist cylinder 18 is in the unlocked state. Although not shown, the bottom end of the column 16 may be mounted to any suitable base. For example, the bottom end of the column 16 may be fixed to a mobile base having wheels or casters. Alternatively, the column 16 may be attached to a base without wheels or casters, or directly to floor or other underlying structure.

As noted above, the height adjustment system 12 of the illustrated embodiment also includes an actuator assembly 36 that mounts to the undersurface of the table top 14 and is operatively coupled to the assist cylinder 18. In use, the actuator assembly 36 provides a mechanism to allow manipulation of the assist cylinder 18 from a plurality of convenient locations about the table top 14. In the illustrated assembly, the actuator assembly 36 is mounted to the undersurface of the table top 14. The actuator assembly 36 of this embodiment includes a pair of paddle assemblies 22 and a linear linkage 24 that operatively couples the paddle assemblies 22 to the assist cylinder 18. The paddle assemblies 22 are mounted on opposite sides of the column 16 and the assist cylinder 18. In the illustrated embodiment, each paddle assembly 22 includes a spanning rod 38 with paddles 40 mounted at or near opposite ends. The spanning rod 38 is rotatably mounted to the undersurface of the table top 14. As shown in FIG. 1, each spanning rod 38 may be affixed to the table top 14 by a pair of brackets 44. The brackets 44 may be sized to closely receive the spanning rods 38 with sufficient clearance to allow rotational movement of the spanning rods 38 within the brackets 44. Bearings, bushing or other friction reduction materials may be fitted between the brackets 44 and the spanning rods 38. As discussed below, the spanning rods 38 may also be attached to support plate 54.

The brackets 44 and paddle assemblies 22 may be configured to control movement of the paddle assemblies 22. For example, in the illustrated embodiment, each spanning rod 38 has a pair of doglegs 42 that interact with the brackets 44 to maintain the longitudinal position of the paddle assembly 22. As perhaps best shown in FIGS. 3 and 4, the brackets 44 may be positioned just inwardly from the doglegs 42 so that interference between the brackets 44 and the bends in the spanning rods 38 prevents substantial movement of the paddle assemblies 22 along the axial direction. As an alternative to doglegs, the spanning rods 38 may include alternative structure configured to interact with the brackets 44 in a similar manner. For example, the spanning rods 38 may be crimped to create protrusions that interact with the brackets 44 or separate components may be attached to the spanning rods 38 to provide the desired interference.

The paddles 40 may extend in a direction generally perpendicular to the longitudinal axis of the spanning rod 38 so that up and down pivotal movement of a paddle 40 causes rotation of the spanning rod 38 about its longitudinal axis. In the illustrated embodiment, each paddle 40 is designed to be operated by a single hand. For example, the paddles 40 include a handle portion 48 configured for easy manipulation and a mounting portion 50 configured for attachment to a spanning rod 38 (See FIG. 2A). To facilitate mounting of the paddles 40, the spanning rods 38 of the illustrated embodiment may include opposed end segments 46 that extend at approximately 90 degrees to the longitudinal axis of the spanning rods 38. In this embodiment, the mounting portion 50 of each paddle 40 defines a mounting hole that is fitted over the free end of the corresponding lateral segment 46. A set screw (not shown) may be used to secure each paddle 40, if desired. The illustrated paddles 40 are merely exemplary. The size, shape and configuration of the paddles may vary from application to application. Although referred to as "paddle" assemblies, the paddle assemblies 22 need not include "paddles", but may instead include other structures suitable for manually rotating the assemblies 22. By way of example, the paddles may be replaced by essentially any alternative structure suitable for providing handles to operate the height adjustment system 12. The paddles need not be separate from the spanning rods. For example, the ends of the spanning rods 38 may be bent or otherwise configured to form paddles that can be manipulated directly without any separate components.

In the illustrated embodiment, each spanning rod 38 includes a radial leg 52 configured to interact with a linkage that operatively joins the paddle assembly 22 to the assist cylinder. In the illustrated embodiment, the leg 52 extends radially from the spanning rod 38 in a generally upward direction from the approximate center of the spanning rod 38. The radial legs 52 extend upwardly through corresponding openings 86 in the support plate 54 (discussed below). As the paddle assembly 22 is rotated the radial leg 52 travels in a sweeping motion (compare FIGS. 6, 7 and 8). In the illustrated embodiment, the sweeping motion of the radial leg 52 is used to impart linear motion to a mating component in the linear linkage 24. More specifically, as described in more detail below, the radial legs 52 are configured to directly engage and provide linear motion to the corresponding components of the linear linkage 24 (e.g. straight drive rod 26 and offset drive rod 28).

The paddle assemblies 22 are operatively coupled to the actuator 20 so that appropriate rotational movement of either paddle assembly 22 moves the actuator 20 to the unlocked position, thereby allowing adjustment to the height of the table top 14. In this embodiment, the paddle assemblies 22 are coupled to the actuator 20 by a linear linkage 24 having a straight drive rod 26, an offset drive rod 28, a pivot arm 30 and a link 82. As shown in FIG. 1, the straight drive rod 26 is disposed between a paddle assembly 24 and the actuator 20 of the assist cylinder 18. In use, upward pivotal motion of the paddle assembly 24 moves the straight drive rod 26 inwardly into the pivot arm 30, which in turn move the link 82 and the actuator of the assist cylinder 18, thereby releasing the assist cylinder 18 and allowing the table top 14 to be raised or lowered as desired. In this embodiment, the straight drive rod 26 is mounted to the support plate 54 by a bracket 64. The bracket 64 is configured to allow axial movement of the straight drive rod 26. For example, the internal diameter of the bracket 64 may be slightly larger than the outer diameter of the straight drive rod 26. As an alternative example, a bushing or bearing or other low friction component may be disposed between the bracket 64 and the straight drive rod 26. As shown, the outer end of the straight drive rod 26 is disposed adjacent the radial leg 52 so that motion of the radial leg 52 is imparted to the straight drive rod 26. The length of the straight drive rod 26 may be adjustable to allow fine tuning of operation of the actuator assembly 36. For example, in the illustrated embodiment, an adjustment screw 66 is threaded into an end of the straight drive rod 26. The adjustment screw 66 may be threaded into or out of the threaded end of the straight drive rod 26 to vary the overall length of the straight drive rod 26. The adjustment screw 66 may be threadedly fitted in either end of the straight drive rod 26 or separate screws may be fitted into both ends. Alternatively or in addition, one or more adjustment screws may be installed in the pivot arm 30 and/or the radial legs 52 to allow adjustment. Although referred to as a "straight" drive rod, the straight drive rod 26 need not be straight, but may instead include one or more bends as desired.

Referring again to FIG. 1, the offset drive rod 28 is disposed between a paddle assembly 24 and the pivot arm 30. The outer end of the offset drive rod 28 is disposed adjacent the radial leg 52 so that motion of the radial leg 52 is imparted to the offset drive rod 28. In use, upward pivotal motion of the paddle assembly 24 causes the radial leg 52 to engage and move the offset drive rod 28 inwardly into the pivot arm 30. The pivot arm 30, in turn, engages and moves the link 82 and the actuator 20 of the assist cylinder 18, thereby releasing the assist cylinder 18 and allowing the table top 14 to be raised or lowered as desired. The offset drive rod 28 is mounted to the support plate 54 by brackets 68. The brackets 68 are configured to allow axial movement of the offset drive rod 28. For example, the internal diameter of the brackets 68 may be slightly larger than the outer diameter of the offset drive rod 28. As an alternative example, a bushing or bearing or other low friction component may be disposed between the brackets 68 and the offset drive rod 28. As with the straight drive rod 26, the length of the offset drive rod 28 may be adjustable to allow tuning of the linear linkage 24. For example, in the illustrated embodiment, an adjustment screw 70 is threaded into an end of the offset drive rod 28. The adjustment screw 70 may be threaded into or out of the threaded end of the offset drive rod 28 to vary the overall length of the offset drive rod 28. The screw 70 may be threadedly fitted in either end of the offset drive rod 28 or separate screws may be fitted into both ends. Alternatively or in addition, one or more adjustment screws may be installed in the pivot arm 30 and/or the radial legs 52 to allow adjustment. Although shown with a pair of bends, the size, shape and configuration of the offset drive rod 28 may vary from application to application.

Figure 2B:
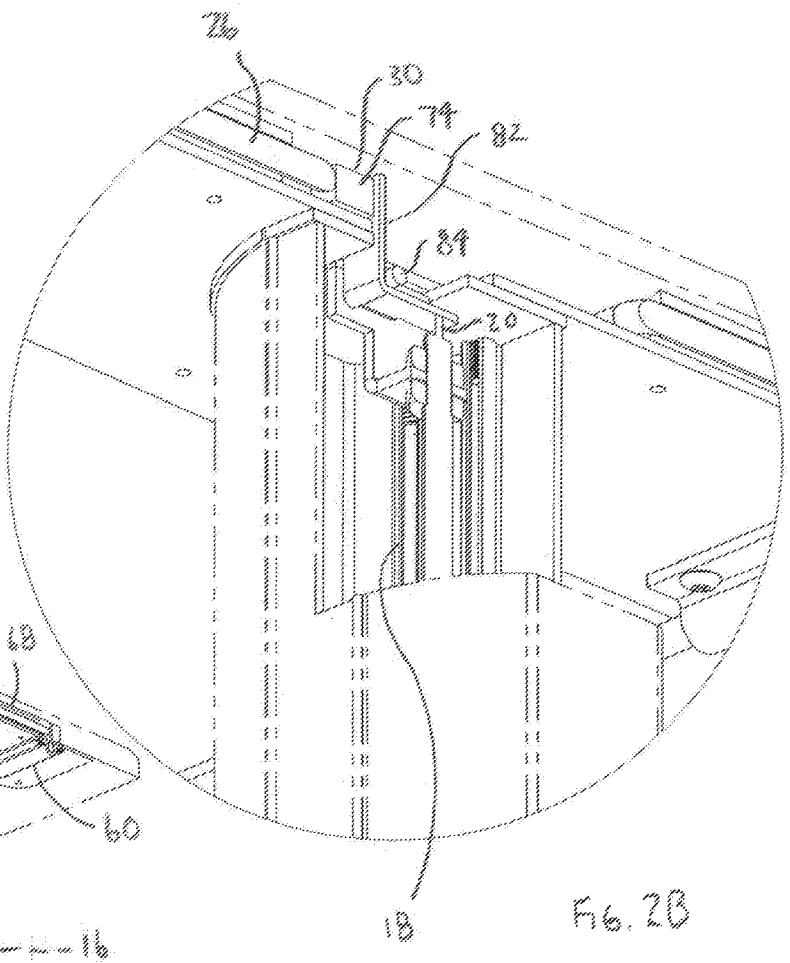
FIG. 2B is an enlarged view of area 2B of FIG. 2A.
Figure 2A:
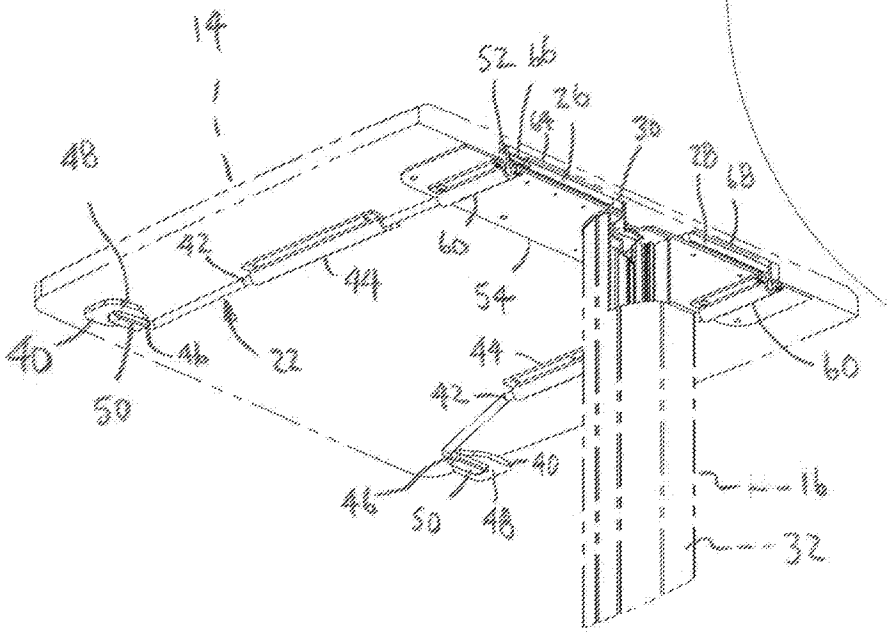
FIG. 2A is a partially sectional bottom perspective view of a portion of the delivery table.

In the illustrated embodiment, the straight drive rod 26 and offset drive rod 28 approach the assist cylinder 18 from opposite sides, but motion in a single direction is utilized to operate the assist cylinder actuator 20. As a result, the linear linkage 24 is configured to reverse the direction of linear motion of one of the drive rods before engagement with the link 82 and the assist cylinder actuator 20. In this embodiment, that function is provided by the pivot arm 30. As noted above, the pivot arm 30 is operatively arranged between the straight drive rod 26, the offset drive rod 28 and the link 82. The pivot arm 30 includes a first portion 72, a second portion 74 and a pivot portion 76. In the illustrated embodiment, the first portion 72 of the pivot arm 30 is operatively engaged with the inner end of the offset drive rod 28 and the second portion 74 is operatively engaged with the straight drive rod 26 and the link 82. The link 82 of this embodiment is an "L" shaped component that is pivotally mounted adjacent to the actuator 20. For example, as shown in FIG. 2A, the link 82 may be affixed by a pin 84 that supports the link 82 and permits it to pivot with respect to the column 16. Although the illustrated link 82 is generally "L" shaped, the linkage 24 may include one or more alternative components capable of operating the actuator 20 in response to movement of the pivot arm 30. In use, link 82 translates generally inward movement of the second portion 74 of the pivot arm 30 into generally downward motion appropriate to depress the actuator 20 and release the assist cylinder 18. As perhaps best shown in FIG. 1, the straight drive rod 26 is engaged with the outer face 78 of the second portion 74 and the link 82 is engaged with the inner face 80 of the second portion 74. As a result of the "reversing" action of the pivot arm 30, inward linear motion of either drive rod 26 or 28 causes the assist cylinder 18 to transition into the unlocked state. More specifically, inward linear motion of the offset drive rod 28 moves the first portion 72 causing the pivot arm 30 to pivot about the pivot portion 76 and the second portion 74 to engage and move the link 82. Movement of the link 82, in turn, operates the assist cylinder actuator 20 (See FIGS. 4 and 7). Inward linear motion of the straight drive rod 26 moves the second portion 74 to engage and move the link 82, thereby operating the assist cylinder actuator 20 (See FIGS. 5 and 8).

Figure 3:
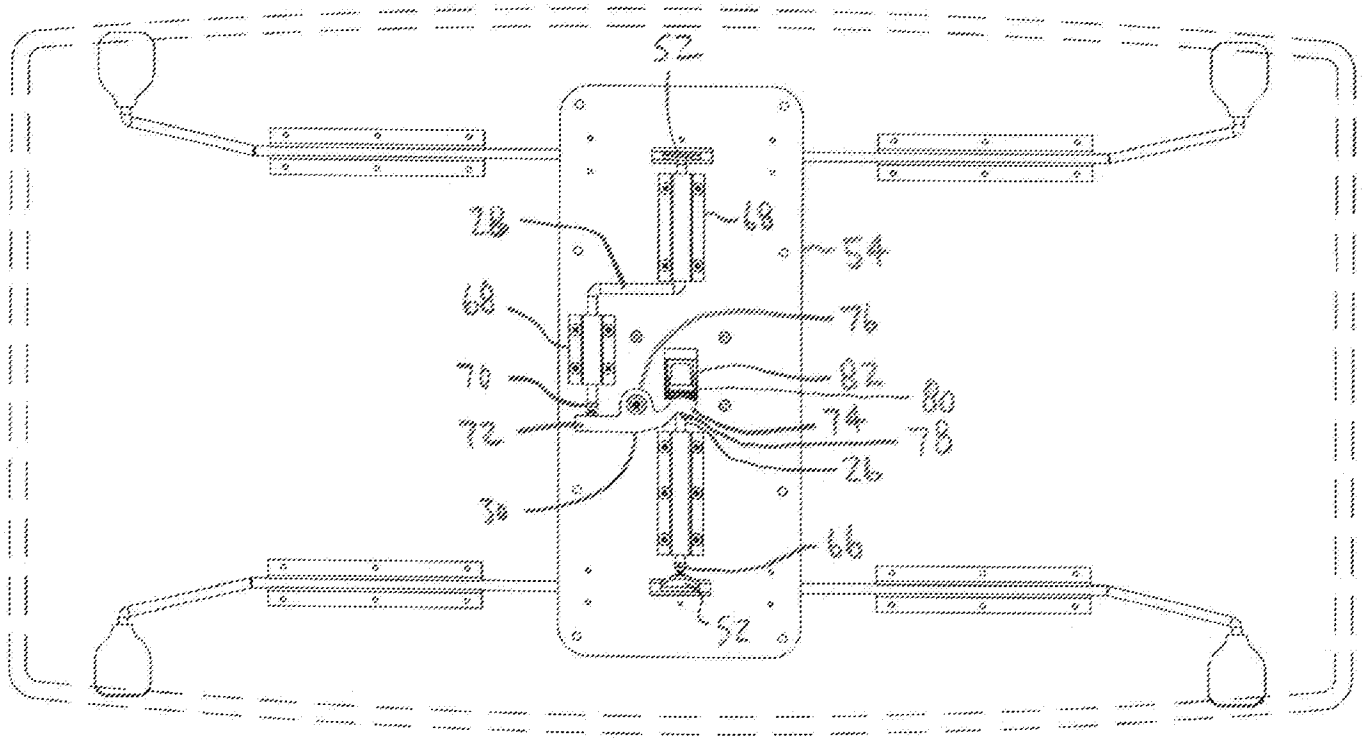
FIG. 3 is a top view of the height adjustment system in the locked position.
Figure 4:
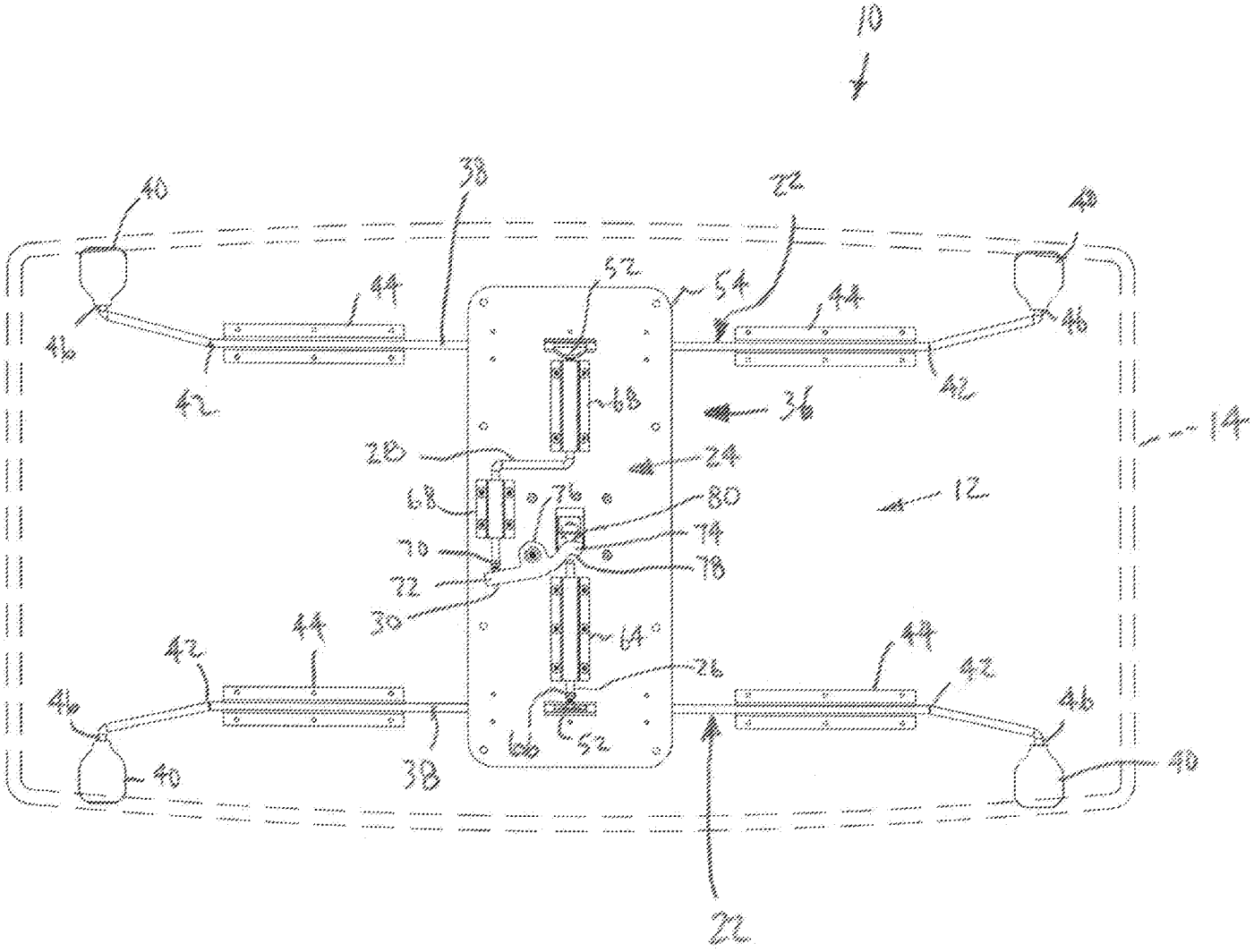
FIG. 4 is a top view of the height adjustment system in the unlocked position with the offset drive rod extended.
Figure 5:
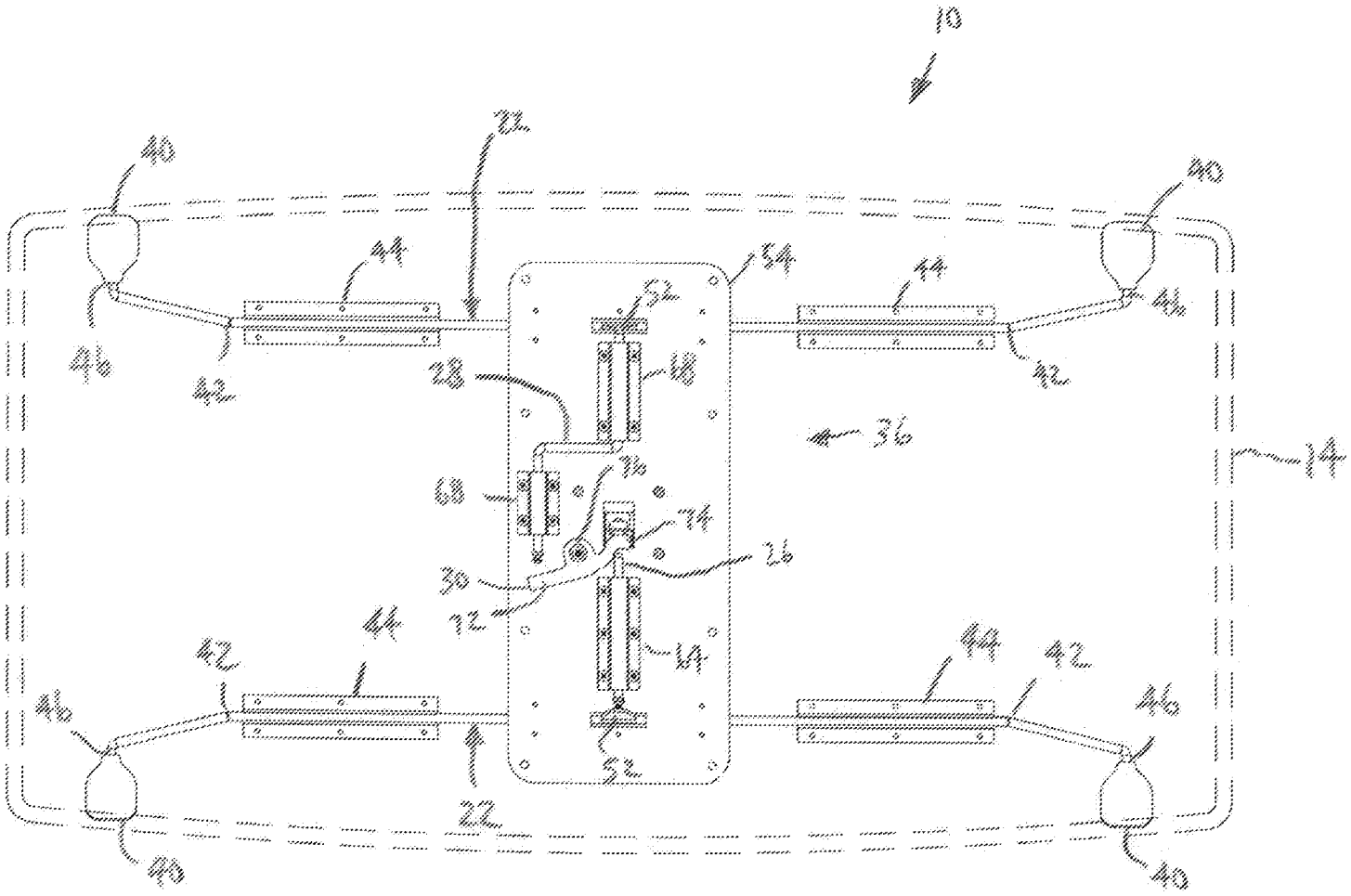
FIG. 5 is a top view of the height adjustment system in the unlocked position with the straight drive rod extended.
Figure 6:
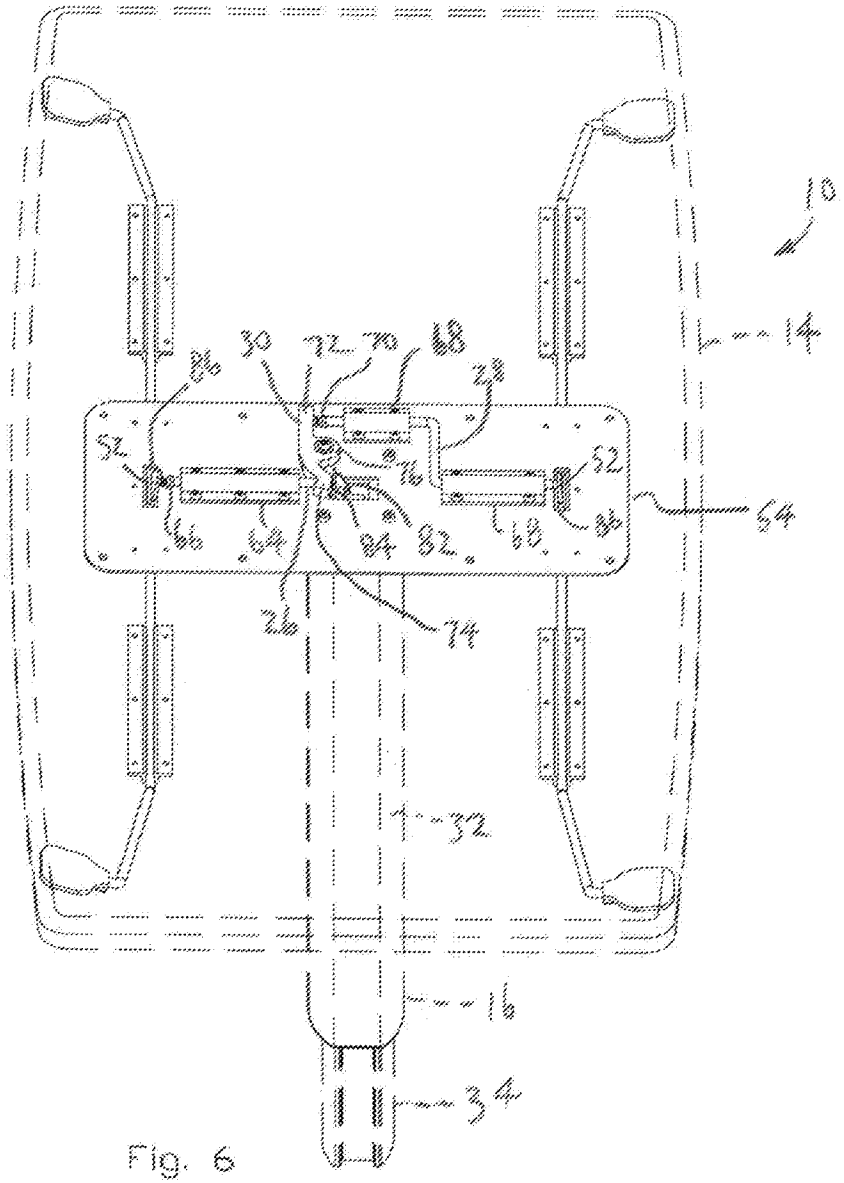
FIG. 6 is a perspective view of the height adjustment system in the locked position.
Figure 7:
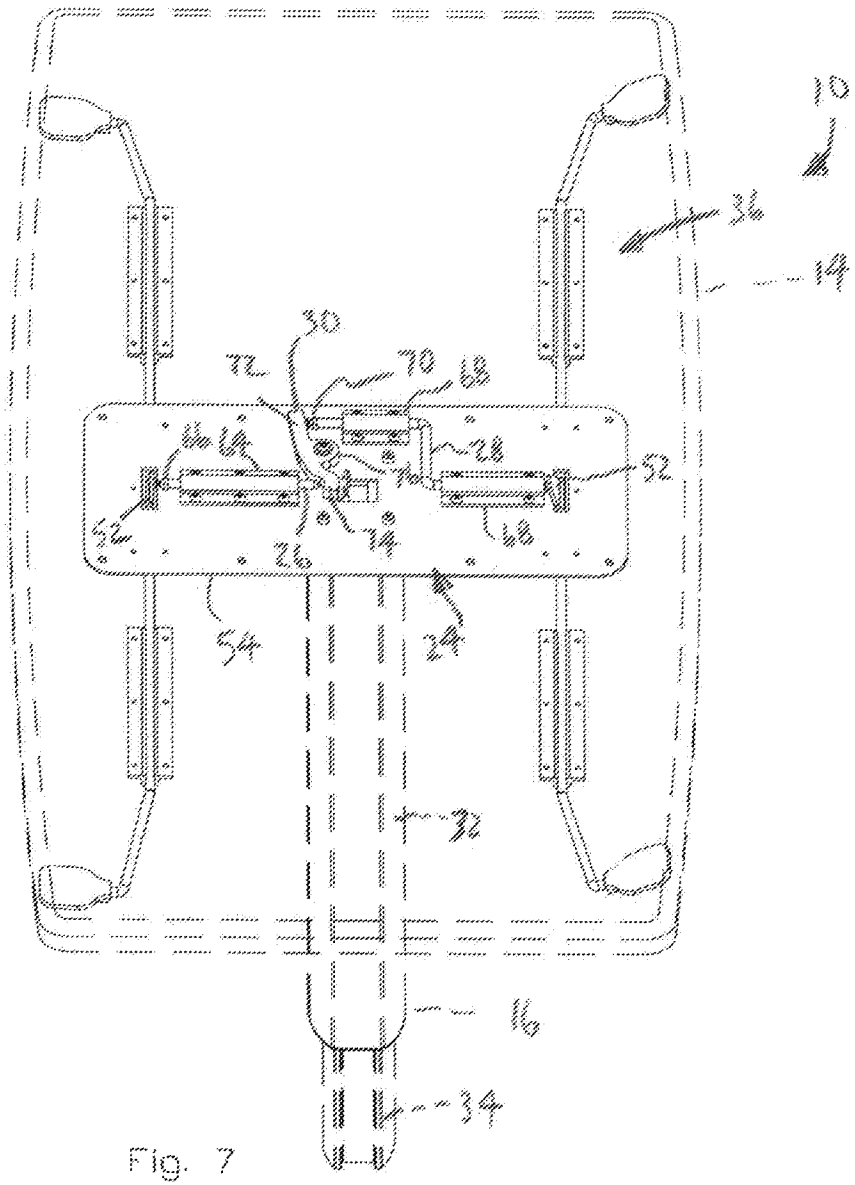
FIG. 7 is a perspective view of the height adjustment system in the unlocked position with the offset drive rod extended.
Figure 8:
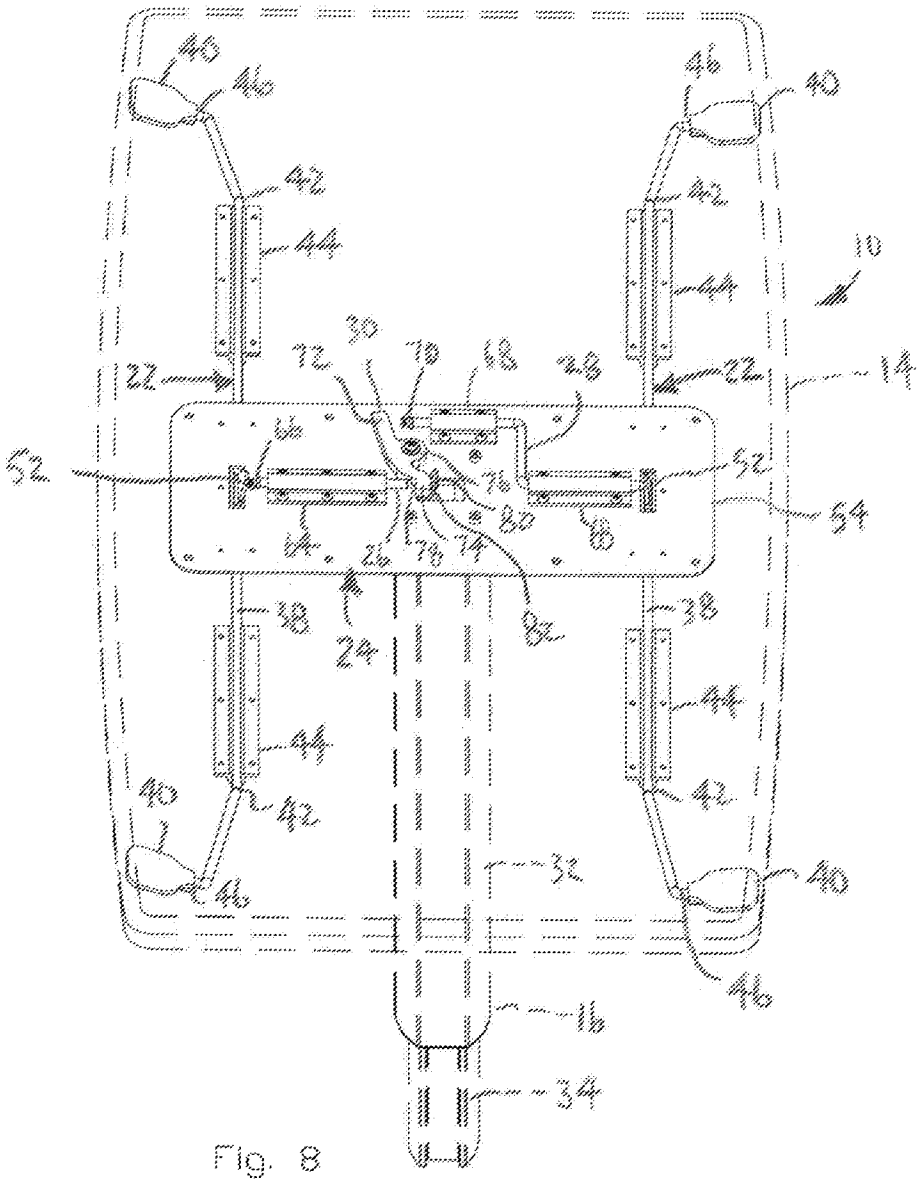
FIG. 8 is a perspective view of the height adjustment system in the unlocked position with the straight drive rod extended.

In the illustrated embodiment, the assist cylinder actuator 20 is biased in the locked position (See FIGS. 3 and 6). The actuator assembly 36 is configured to use the bias in the assist cylinder actuator 20 to bias the paddle assemblies 22 and the liner linkage 24 in their locked positions. More specifically, when the user ceases applying enough force to the paddle assemblies 22 to unlock the assist cylinder 18, the bias of the assist cylinder actuator 20 urges the link 82 upwardly and the second portion 74 of the pivot arm 30 outwardly, thereby pushing the straight drive rod 26 outwardly which, in turn, swings the radial leg 52 outwardly and pivots the associated paddle assembly 22, thereby moving the paddles into the locked position. At the same time, outward movement of the second portion 74 of the pivot arm 30 causes the first portion 72 of the pivot arm 30 to engage and move the offset drive rod 28 outwardly. Outward motion of the offset drive rod 28 swings the radial leg 52 of the mating paddle assembly 22 outwardly and pivots the associated paddles into the locked position.

In the illustrated embodiment, the linear linkage 24 is mounted to and carried by a support plate 54 affixed to the top of the column 16. For example, in this embodiment, the support plate 54 is secured to the column 16 by four screws 56. As described in more detail below, one of the screws also extends through the pivot arm 30. In the illustrated embodiment, the support plate 54 is also secured to the undersurface of the table top 14. For example, the table top 14 may be mounted to the support plate 54 by screws (not shown) extending upwardly through screw holes 58. In the illustrated embodiment, the undersurface of the table top 14 is shaped to receive the linear linkage 24. For example, the table top 14 may include one or more voids in which the linear linkage 24 is fitted. In the illustrated embodiment, the paddles assemblies 22 are also secured to the support plate 54. For example, as perhaps best shown in FIG. 2, each paddle assembly 22 may be rotatably affixed to the support plate 54 by a bracket 60. The bracket 60 may be secured to the support plate by screws 62 or other fasteners. Although mounted to the top surface of the support plate 54, the linear linkage 24 may alternatively be mounted to the bottom surface of the support plate 54. As noted above, the radial legs 52 may extend from below the support plate 54 to the linear linkage 24 mounted atop the support plate 54. For example, the radial legs 52 may extend through openings 86 of sufficient size to accommodate the radial legs 52 through their full range of motion. The support plate 54 is merely exemplary and the linear linkage 24 may be mounted to the table 10 using essentially any suitable alternative construction. For example, the linear linkage 24 may be secured directly to the table top 14. In that alternative, the brackets securing the various components to the support plate 54 can be used to secure those components directly to the undersurface of the table top 14.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A height-adjustable table comprising:

a table top, a base, a column extending upwardly from said base to support said table top, said column configured to be adjustable in length to allow selective control over the height of the table top, said column including an assist cylinder having a locked state in which said length of said column is secured and an unlocked state in which said length of said column is readily adjustable; and an actuator assembly operatively coupled to said assist cylinder to allow a user to manually place said assist cylinder in said unlocked state, said actuator assembly including a pair of paddle assemblies and a linear linkage, said paddle assemblies pivotally disposed toward opposite sides of said table top, said linear linkage having a first drive rod operatively engaged with one of said paddle assemblies, a second drive rod operatively engaged with another of said paddle assemblies and a pivot arm, wherein pivotal movement of any one of said paddle assemblies results in movement of said assist cylinder between locked and unlocked states, said pivot arm having a first portion, a second portion and a pivot portion, said first portion and said second portion disposed on opposite sides of said pivot portion, said first drive rod being operatively engaged with said first portion and said second drive rod being operatively engaged with said second portion; and wherein said second portion is engaged with said assist cylinder, said pivot arm configured to reverse linear motion of said second drive rod.

2. The height-adjustable table of claim 1 wherein at least one of said first drive rod and said second drive rod is length-adjustable.

3. The height-adjustable table of claim 1 wherein a first length adjustment screw is fitted into an end of said first drive rod and a second length adjustment screw is fitted into an end of said second drive rod.

4. The height-adjustable table of claim 3 wherein each paddle assembly includes a spanning rod and is affixed to the table top by at least one bracket fitted over said spanning rod, said spanning rod including at least one bend configured to interact with said bracket to control movement of said spanning rod in an axial direction.

5. The height-adjustable table of claim 3 wherein each paddle assembly includes a spanning rod and is affixed to the table top by at least two brackets fitted over said spanning rod, said spanning rod including a first bend configured to interact with one of said brackets to control movement of said spanning rod in a first axial direction and a second bend configured to interact with another of said brackets to control movement of said spanning rod in a second axial direction.

6. The height-adjustable table of claim 5 wherein each spanning rod includes a radial leg operatively engaged with at least one of said first drive rod and said second drive rod.

7. A table comprising:

a table top;

a base;

a column extending between the table top and the base, the column being height adjustable to allow selective variation in a height of the table top relative to the base, the column including an assist cylinder selectively operable between a locked mode in which the assist cylinder holds the table top at the current height to an unlocked mode in which a user may adjust the current height of the table top, the assist cylinder having an actuator movable in a first direction to actuate the assist cylinder into the unlocked mode and movable is a second direction to actuate the assist cylinder into the locked mode; and a height-adjustment system coupled to the assist cylinder to allow a user to manually place the assist cylinder in the unlocked mode to allow adjustment in the height of the column, the height adjustment system including a first paddle assembly and a second paddle assembly, the paddle assemblies pivotally mounted to the table top and disposed on opposite sides of the assist cylinder, the height adjustment system including a first drive rod coupled between the first paddle assembly and the assist cylinder and a second drive rod coupled between the second paddle assembly and the assist cylinder, the height adjustment system further including a pivot arm to configured to communicate motion of the first drive rod and the second drive rod to the assist cylinder actuator, the pivot arm configured to reverse motion of one of the drive rods such that operation of either paddle assembly results in movement of the actuator in the first direction.

8. The table of claim 7 wherein at least one of the first drive rod and the second drive rod is length-adjustable.

9. The table of claim 8 wherein a first length adjustment screw is fitted into an end of the first drive rod and a second length adjustment screw is fitted into an end of the second drive rod.

10. The table of claim 7 wherein each paddle assembly includes a spanning rod and is affixed by at least one bracket fitted over the spanning rod, the spanning rod including at least one bend configured to interact with the bracket to control movement of the spanning rod in an axial direction.

11. The table of claim 10 wherein each paddle assembly includes a spanning rod and is affixed by at least two brackets fitted over the spanning rod, each spanning rod including a first bend configured to interact with one of the brackets to control movement of the spanning rod in a first axial direction and a second bend configured to interact with another of the brackets to control movement of the spanning rod in a second axial direction.

12. The table of claim 10 wherein each spanning rod includes a radial leg operatively engaged with at least one of the first drive rod and the second drive rod.

* * * * *